US005112090A

United States Patent [19]

Stogsdill

[11] Patent Number: 5,112,090

[45] Date of Patent: May 12, 1992

[54] SECURITY LOCK APPARATUS

[76] Inventor: Voyd E. Stogsdill, 18868 Westlawn, Hesperia, Calif. 92345

[21] Appl. No.: 729,441

[22] Filed: Jul. 12, 1991

[51] Int. Cl.[5] ..... E05C 19/18

[52] U.S. Cl. ..... 292/258; 292/DIG. 46; 292/1

[58] Field of Search ..... 292/258, 259, 257, 262, 292/DIG. 46, 1

[56] References Cited

U.S. PATENT DOCUMENTS

| | | | |
|---|---|---|---|
| 3,282,618 | 11/1966 | Adickes | 292/258 |
| 3,756,641 | 9/1973 | Dugan | 292/258 |
| 4,062,576 | 12/1977 | Jennings et al. | 292/DIG. 46 X |
| 4,148,508 | 4/1979 | Adair | 292/258 |
| 4,630,853 | 12/1986 | Bell | 292/258 |

*Primary Examiner*—Richard E. Moore

*Attorney, Agent, or Firm*—Leon Gilden

[57] ABSTRACT

An apparatus secured to a framework of a sliding window or door framework to receive a frame flange therewithin and provide an abutment plate to effect abutment and prevent unwarranted opening of a sliding framework relative to the fixed framework. The rigid body includes a slot to receive the framework flange therewithin, with an abutment flange mounted to a top wall of the body providing abutment for the framework slidably mounted relative to the fixed framework. A modification of the invention includes a plurality of rigid bodies mounting an abutment housing, with the abutment housing including an actuator rod displaceable relative to the abutment housing to effect actuation of a signal member defined as an inflation balloon upon deflection of the actuator rod relative to the housing.

3 Claims, 5 Drawing Sheets

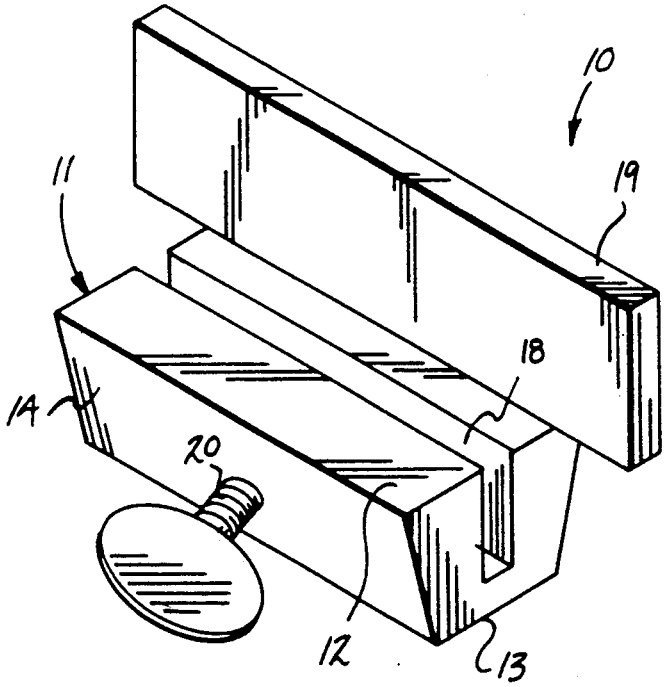
Fig 1
Fig 2
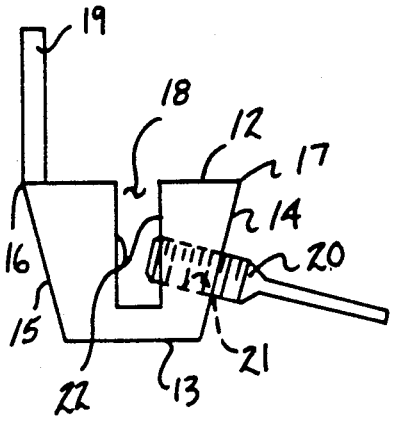
Fig 3
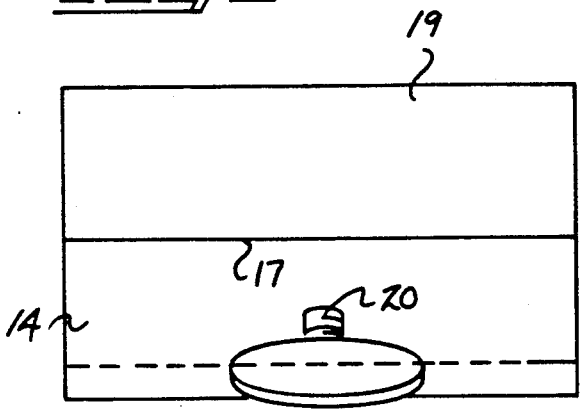

SECURITY LOCK APPARATUS

BACKGROUND OF THE INVENTION

1. Field of the Invention

The field of invention relates to security locking arrangements, and more particularly pertains to a new and improved security lock apparatus wherein the same is arranged for providing an abutment surface preventing displacement of a sliding framework relative to a fixed framework in a window or door enclosure.

2. Description of the Prior Art

Security devices of various types have been utilized in the prior art to prevent unwanted opening of a window or door framework relative to a dwelling to prevent the window or door from being slid horizontally in its associated frame. Prior art devices directed to this problem include U.S. Pat. No. 4,881,768 to Lange setting forth a security device arranged for preventing displacement of a window framework or door framework relative to an associated surrounding rigid framework.

U.S. Pat. No. 4,073,517 to Bills sets forth a lock member mounted to a sliding framework to prevent its displacement relative to a surrounding fixed framework.

U.S. Pat. No. 4,875,349 to Girard sets forth a locking device for use in double sliding doors.

U.S. Pat. No. 4,379,576 to Blough sets forth a bracket member mounted to a sliding window or door framework preventing its unwarranted displacement.

U.S. Pat. No. 4,907,832 to Pemberton sets forth a further example of a locking mechanism mounted to a sliding window or door framework.

As such, it may be appreciated that there continues to be a need for a new and improved security lock apparatus as set forth by the instant invention which addresses both the problems of ease of use as well as effectiveness in construction in providing selective mounting of the apparatus relative to a fixed framework relative to a sliding framework of a window or door and in this respect, the present invention substantially fulfills this need.

SUMMARY OF THE INVENTION

In view of the foregoing disadvantages inherent in the known types of security lock apparatus now present in the prior art, the present invention provides a security lock apparatus wherein the same is arranged for selective mounting to a framework flange of an associated sliding door or window preventing unwarranted displacement of the sliding framework relative to the fixed framework. As such, the general purpose of the present invention, which will be described subsequently in greater detail, is to provide a new and improved security lock apparatus which has all the advantages of the prior art security lock apparatus and none of the disadvantages.

To attain this, the present invention provides an apparatus secured to a framework of a sliding window or door framework to receive a frame flange therewithin and provide an abutment plate to effect abutment and prevent unwarranted opening of a sliding framework relative to the fixed framework. The rigid body includes a slot to receive the framework flange therewithin, with an abutment flange mounted to a top wall of the body providing abutment for the framework slidably mounted relative to the fixed framework. A modification of the invention includes a plurality of rigid bodies mounting an abutment housing, with the abutment housing including an actuator rod displaceable relative to the abutment housing to effect actuation of a signal member defined as an inflation ballon upon deflection of the actuator rod relative to the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved security lock apparatus which has all the advantages of the prior art security lock apparatus and none of the disadvantages.

It is another object of the present invention to provide a new and improved security lock apparatus which may be easily and efficiently manufactured and marketed.

It is a further object of the present invention to provide a new and improved security lock apparatus which is of a durable and reliable construction.

An even further object of the present invention is to provide a new and improved security lock apparatus which is susceptible of a low cost of manufacture with regard to both materials and labor, and which accordingly is then susceptible of low prices of sale to the consuming public, thereby making such security lock apparatus economically available to the buying public.

Still yet another object of the present invention is to provide a new and improved security lock apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic side view of the invention.

FIG. 3 is an orthographic frontal view, taken in elevation, of the instant invention.

DESCRIPTION OF THE PREFERRED EMBODIMENT

Figure 4:
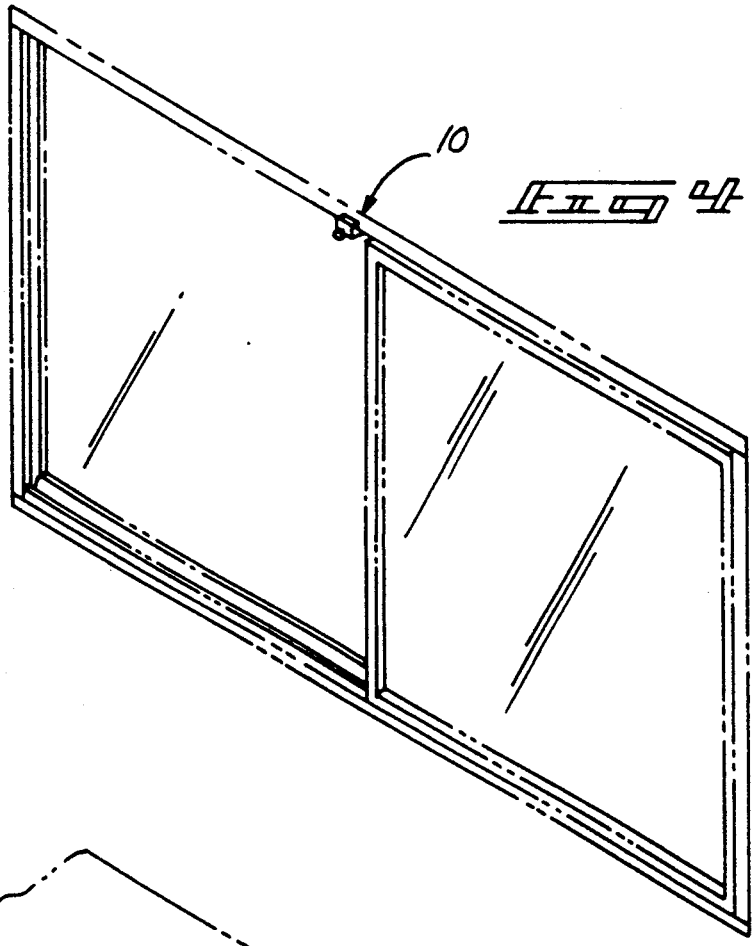
FIG. 4 is an isometric illustration of the invention mounted to an associated window or door framework.
Figure 5:
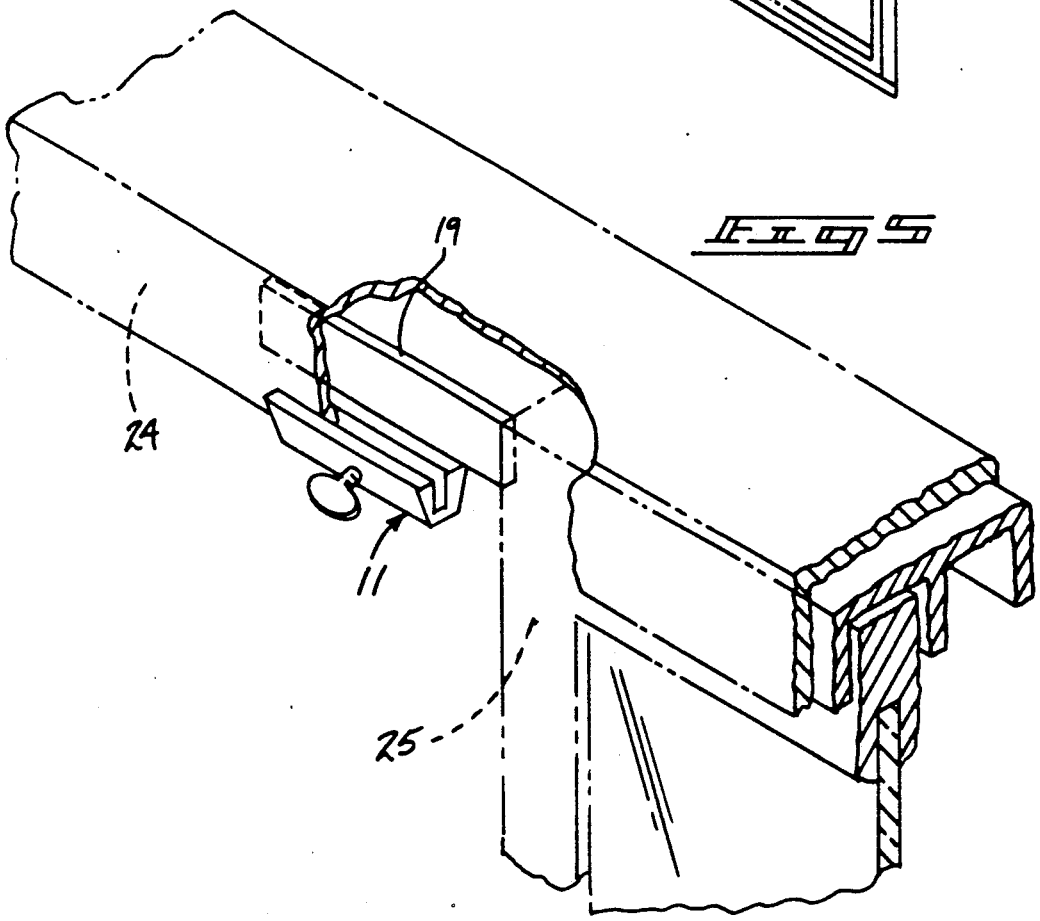
FIG. 5 is an enlarged isometric illustration of the invention mounted to the framework, as illustrated in FIG. 4.
Figure 6:
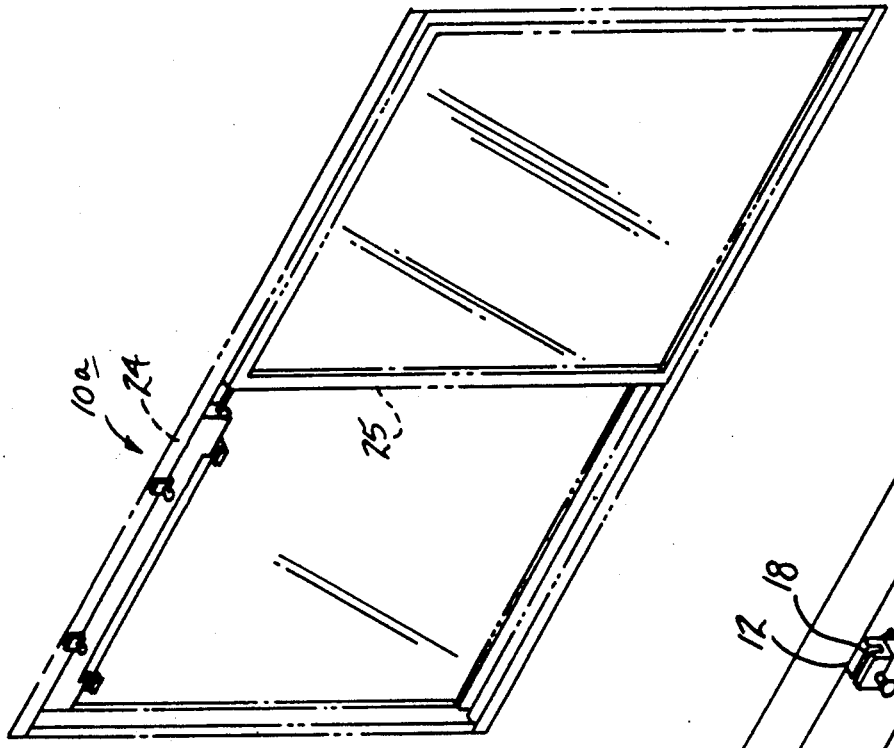
FIG. 6 is an isometric illustration of a modified apparatus mounted within a sliding window or door framework.
Figure 7:
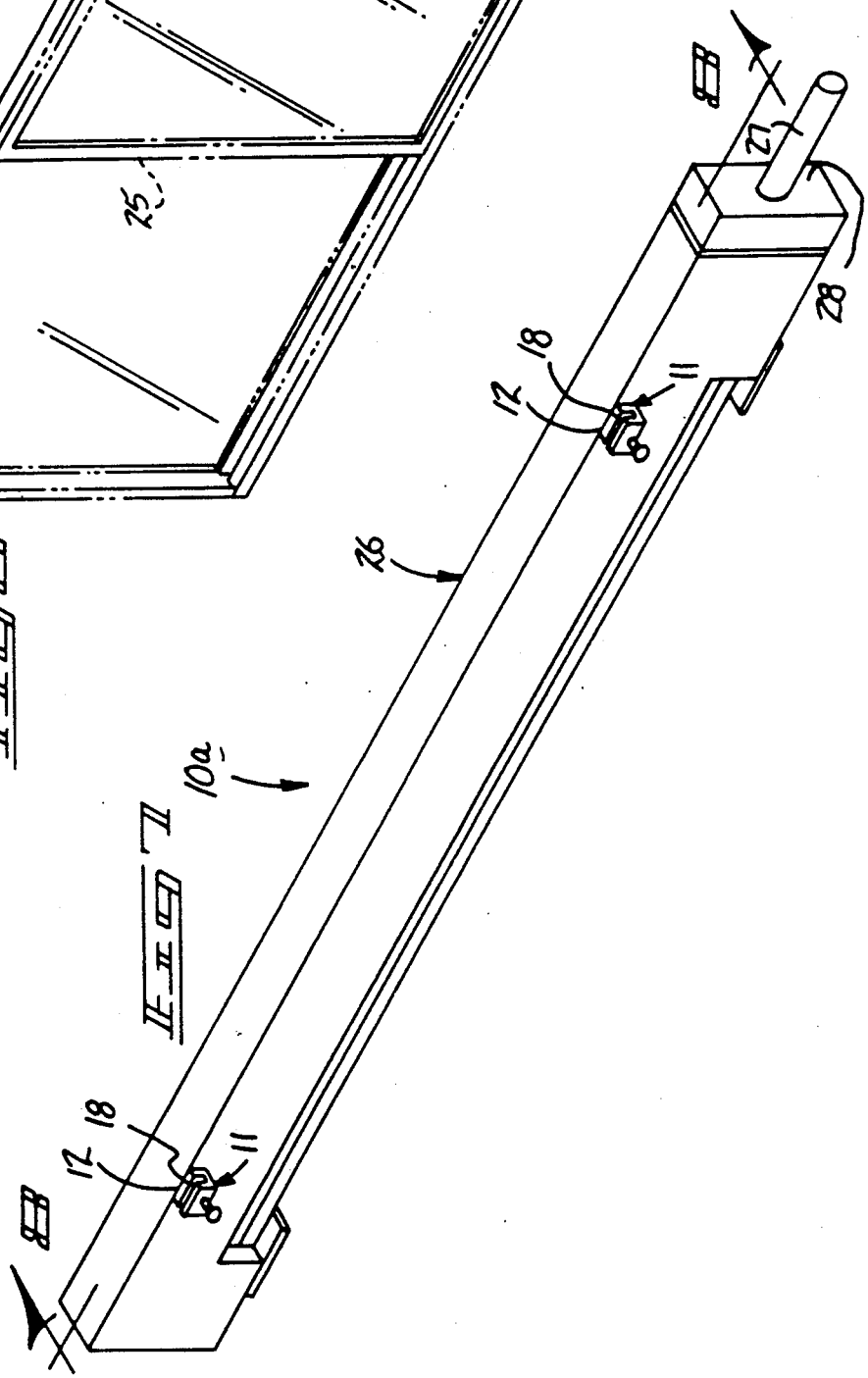
FIG. 7 is an enlarged isometric illustration of the modified apparatus.
Figure 8:
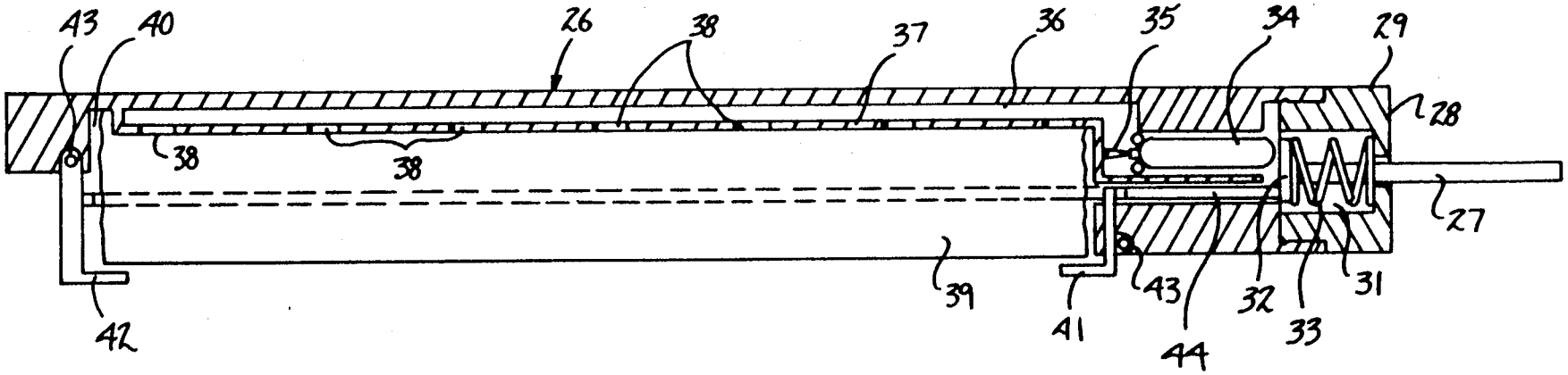
FIG. 8 is an orthographic view, taken along the lines 8—8 of FIG. 7 in the direction indicated by the arrows.

With reference now to the drawings, and in particular to FIGS. 1 to 9 thereof, a new and improved security lock apparatus embodying the principles and concepts of the present invention and generally designated by the reference numerals 10 and 10*a* will be described.

More specifically, the security lock apparatus 10 of the instant invention essentially comprises a rigid body 11 defined by a top wall 12 spaced above a bottom wall 13 spaced apart a predetermined height. A front wall 14 is spaced from a rear wall 15. The top wall includes a top wall rear edge 16 spaced from a top wall front edge 17. A slot 18 is directed downwardly from the top wall 12 in an orthogonal relationship towards the bottom wall 13 defining a slot depth less than the predetermined height between the top and bottom walls 12 and 13. An abutment plate 19 is fixedly and integrally mounted in an orthogonal relationship relative to the top wall 12 coextensive with the rear edge 16 extending beyond the side walls of the rigid body 11 longitudinally aligned relative to the rigid body 11.

An externally threaded lock bolt 20 is received within an internally threaded bore 21, wherein the bore 21 intersects the front wall 14 and a side wall 22 of parallel side walls defining the slot 18. The internally threaded bore 21 defines an acute included angle in its intersection with the side wall 22, as illustrated in FIG. 2 for example, to provide a wedging or camming action relative to a frame flange 24 (see FIG. 5) of an associated rigid framework, wherein upon mounting the rigid body 11 relative to the frame flange 24, the abutment plate 19 functions as an abutment to prevent undesirable displacement of the door or window frame 25.

Figure 9:
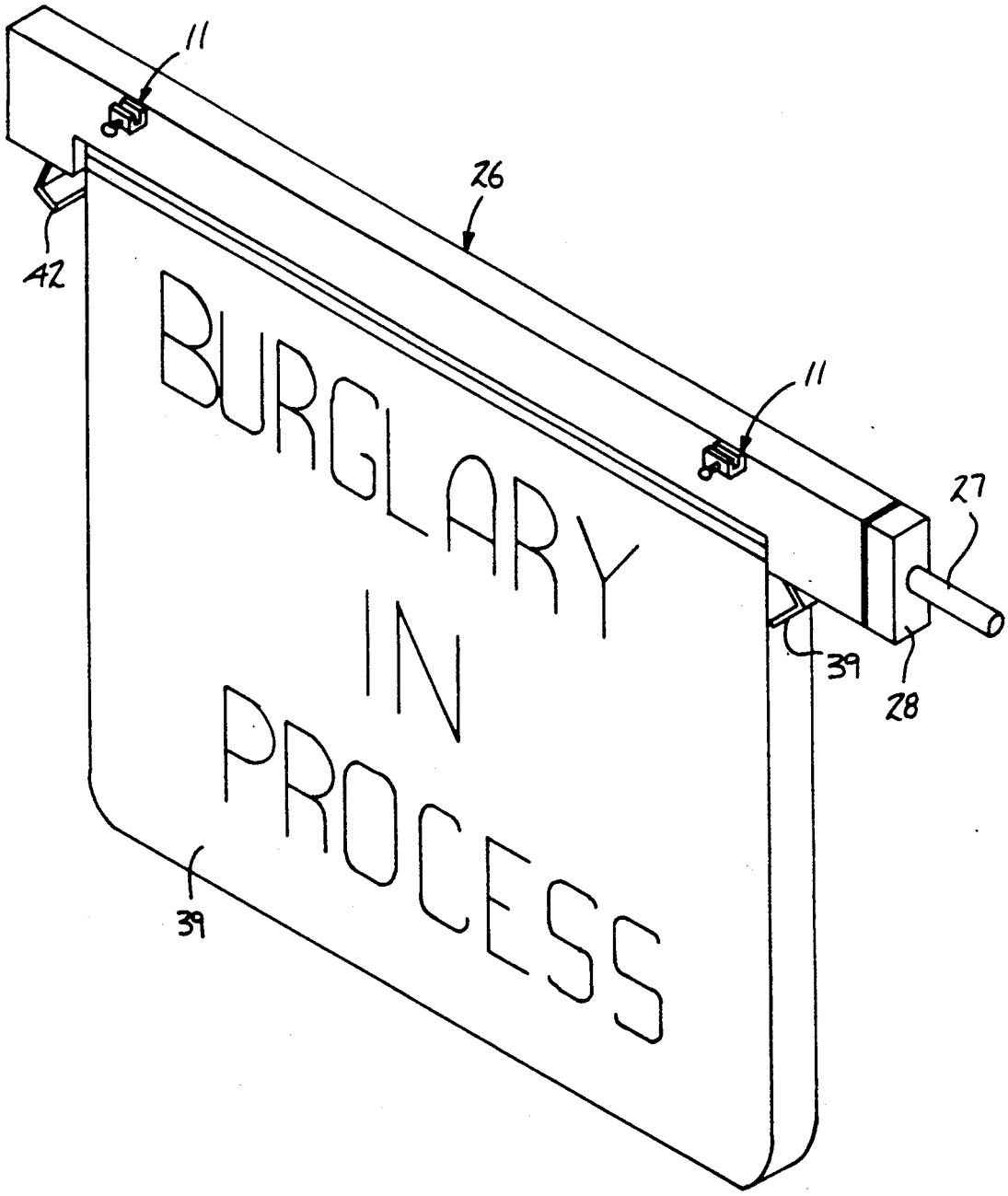
FIG. 9 is an isometric illustration of the modified invention in an operative configuration.

FIGS. 6–9 illustrate a modified security lock apparatus 10*a*, wherein a plurality of rigid bodies 11 are fixedly and integrally mounted to a forward wall of an abutment housing 26. The abutment housing 26 is mounted fixedly to the rear wall 15 of each rigid body 11, with the abutment housing 26 including an abutment housing top wall substantially coplanar with the top walls 12 of each rigid body 11. An abutment rod 27 is slidably mounted in an orthogonal relationship relative to a housing forward end wall 28 that is orthogonally oriented relative to the top wall of the abutment housing 26. The housing forward end wall 28 is part of a housing cap 29 removably mounted relative to the housing 26. A housing cap cavity 31 is defined within the housing cap and contains a rod plate 32 integrally and orthogonally mounted to an interior end of the actuator rod 27. A captured spring 33 contained within the cap cavity 31 between the plate 32 and an interior surface of the housing forward end wall 28 biases the rod plate 32 in contiguous communication with a compressed gas cylinder 34 and a displacement rod 44, each orthogonally oriented relative to the rod plate 32. The compressed gas cylinder 34 includes a piercing peg 35 aligned with the entrance opening of the compressed gas canister 34, whereupon displacement of the actuator rod 27 effects piercing of the compressed gas canister 34 and simultaneous displacement of the displacement rod 44. A gas conduit 36 extends within the housing 26 between the gas cylinder 34 coextensively within a ballon cavity 40 within the housing mounting a ballon to an exterior surface of the conduit floor 37. The conduit floor 37 includes a series of spaced conduit floor openings 38. Gas directed through the gas conduit 36 directs the gas from the canister 34 through the openings 38 into a balloon 39 mounted fixedly to the conduit floor 37. In this manner, the balloon 39 is expanded from within the cavity 40, wherein simultaneous displacement of the displacement rod 44 effects pivotment of at least one of the first and second "L" shaped support legs 41 and 42 that are pivotally mounted to the housing 26 about pivots 43. In this manner, the balloon 39 projects downwardly including associated logo, as illustrated in FIG. 9, to provide visual indication of unwarranted displacement of an associated door or window frame 25 relative to the fixed frame of the window or door arrangement.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A security lock apparatus for securement to a frame flange containing a sliding frame slidably mounted relative to the frame flange, wherein the apparatus comprises, at least one rigid body, the rigid body including a top wall spaced from a bottom wall a predetermined height, and a front wall spaced from a rear wall, and including spaced side walls, and the rigid body including a slot orthogonally oriented relative to the top wall extending downwardly relative to the top wall a predetermined depth less than the predetermined height, and the top wall including a top wall rear edge spaced from a top wall front edge, and the top wall rear edge including abutment means mounted in contiguous communication to the rear edge for abutment of the sliding frame when the flange is mounted within the slot, and the slot including spaced parallel side walls, each side wall orthogonally oriented relative to the top wall, and the front wall including an internally threaded bore directed from the front wall extending through at least one side wall, and an externally threaded lock bolt threadedly received within the internally threaded bore, wherein the lock bolt projects into the slot, and the internally threaded bore defines an acute included angle in the at least one side wall and the internally threaded bore, and the abutment means includes a plate member, the plate member fixedly mounted to the rear edge extending laterally beyond each side wall of the rigid body, and the abutment means includes an abutment housing, the abutment housing including an abutment housing top wall, the abutment housing top wall substantially coextensive with the top wall of the rigid body, and the abutment housing including a housing forward end wall orthogonally oriented relative to the abutment housing top wall and positioned beyond the rigid body, the forward housing end wall including a cavity positioned within the abutment housing adjacent the abutment housing forward end wall, and an actuator rod orthogonally and slidably directed through the abutment housing forward end wall positioned within the cavity, and the actuator rod including a rod plate positioned within the cavity orthogonally oriented relative to the actuator rod, and a captured spring positioned between the rod plate and an interior surface of the abutment housing forward end wall, and a compressed gas canister orthogonally oriented relative to and adjacent the rod plate in contiguous communication with the rod plate, and a displacement rod positioned in contiguous communication with the rod plate adjacent the compressed gas canister, and the gas conduit directed through the housing, the compressed gas canister including a conduit floor, the conduit floor positioned above a balloon cavity, wherein the balloon cavity is directed through an abutment housing bottom wall within the abutment housing, and the balloon housing cavity including a balloon contained within the balloon cavity fixedly mounted to the conduit floor, the conduit floor including a plurality of conduit floor openings, wherein each conduit floor opening is directed interiorly of the balloon, and a piercing rod positioned in longitudinal alignment with the compressed gas canister for piercing the compressed gas canister to direct compressed gas through the gas conduit, through the conduit floor openings, and into the balloon upon displacement of the actuator rod within the abutment housing.

2. An apparatus as set forth in claim 1 wherein the abutment housing floor includes a plurality of "L" shaped support legs positioned below the balloon cavity, wherein at least one of the "L" shaped support legs are in contiguous communication with the displacement rod spaced from the rod plate, whereupon displacement of the rod plate effects displacement of the at least one "L" shaped leg to permit projection of the balloon exteriorly of the balloon cavity.

3. An apparatus as set forth in claim 2 wherein each of the plurality of "L" shaped support legs include a pivot, the pivot mounted within the housing adjacent the balloon cavity.

* * * * *